US007364322B2

(12) United States Patent
Oppor et al.

(10) Patent No.: US 7,364,322 B2
(45) Date of Patent: Apr. 29, 2008

(54) APPLIANCE CONVENIENCE LIGHT

(75) Inventors: Rick L. Oppor, Schaumburg, IL (US); Bahar N. Wadia, Wheaton, IL (US); Donald Charles Mueller, Aurora, IL (US); David Allen Wolff, Saint Charles, IL (US)

(73) Assignee: TouchSensor Technologies, LLC, Wheaton, IL (US)

( * ) Notice: Subject to any disclaimer, the term of this patent is extended or adjusted under 35 U.S.C. 154(b) by 0 days.

(21) Appl. No.: 11/149,838

(22) Filed: Jun. 10, 2005

(65) Prior Publication Data

US 2005/0276046 A1 Dec. 15, 2005

Related U.S. Application Data

(60) Provisional application No. 60/578,590, filed on Jun. 10, 2004.

(51) Int. Cl.
*F21V 21/00* (2006.01)
*F21V 7/04* (2006.01)

(52) U.S. Cl. ..... 362/247; 362/249; 362/240; 362/219

(58) Field of Classification Search ..... 362/240, 362/241, 247, 249, 545, 800, 219, 235; 315/249
See application file for complete search history.

(56) References Cited

U.S. PATENT DOCUMENTS

| | | | | |
|---|---|---|---|---|
| 2,648,305 | A | 8/1953 | Appleman | |
| 5,464,955 | A | 11/1995 | Cole | |
| 5,698,826 | A | 12/1997 | Cracraft et al. | |
| 5,718,501 | A | 2/1998 | White | |
| 5,854,541 | A | 12/1998 | Chou | |
| 6,561,690 | B2 * | 5/2003 | Balestriero et al. | 362/555 |
| 6,592,238 | B2 * | 7/2003 | Cleaver et al. | 362/249 |
| 6,601,970 | B2 * | 8/2003 | Ueda et al. | 362/217 |
| 6,641,284 | B2 * | 11/2003 | Stopa et al. | 362/240 |
| 6,648,496 | B1 | 11/2003 | Elghoroury et al. | |
| 6,676,284 | B1 * | 1/2004 | Wynne Willson | 362/555 |
| 6,789,923 | B2 * | 9/2004 | Liao | 362/294 |
| 6,971,767 | B2 * | 12/2005 | Agabekov et al. | 362/249 |
| 7,049,757 | B2 * | 5/2006 | Foust et al. | 315/185 S |
| 2002/0006039 | A1 | 1/2002 | Ueda et al. | |
| 2002/0027778 | A1 | 3/2002 | Ko | |
| 2002/0043943 | A1 * | 4/2002 | Menzer et al. | 315/291 |
| 2002/0118548 | A1 | 8/2002 | Kuenstler et al. | |
| 2004/0021425 | A1 * | 2/2004 | Foust et al. | 315/169.3 |
| 2005/0073827 | A1 * | 4/2005 | Li | 362/29 |
| 2005/0195602 | A1 * | 9/2005 | Pan | 362/245 |

FOREIGN PATENT DOCUMENTS

| | | | |
|---|---|---|---|
| DE | 19938734 | A1 | 3/2001 |
| EP | 1348904 | A1 | 1/2003 |

* cited by examiner

*Primary Examiner*—Thomas M. Sember
(74) *Attorney, Agent, or Firm*—Jenner & Block, LLP

(57) ABSTRACT

A lighting apparatus includes multiple point light sources housed in a reflector housing. The reflector housing diffuses the light produced by the point light sources to emulate a linear light source. Power supplies are provided to energize the light sources, to control heat generation and energy usage, and to provide thermal protection.

22 Claims, 5 Drawing Sheets

APPLIANCE CONVENIENCE LIGHT

CROSS REFERENCE TO RELATED APPLICATIONS

This application claims benefit of U.S. Provisional Patent Application No. 60/578,590, filed Jun. 10, 2004, the disclosure of which is incorporated herein by reference.

BACKGROUND OF THE INVENTION

1. The Technical Field

The present invention is directed to electric lighting generally and, in preferred embodiments, to convenience lighting for appliances.

2. The Prior Art

Modern appliances commonly include convenience lights. For example, refrigerators and microwave ovens typically include interior lighting to better enable a user to see their contents. Also, modern refrigerators often include ice and water dispensers located in a recess in a door panel. These recesses typically include lights to facilitate operation of the dispenser in the dark. These lights also can be used as night lights. Ranges sometimes include a backlit control panel which can double as a night light. Microwave oven/range hood combinations commonly include underhood lighting to illuminate the underlying range surface and cooking area. These lights can be used as night lights, as well.

Known convenience lights typically use conventional incandescent and fluorescent lighting technologies. These technologies are well-developed and have many advantages, but also have inherent shortcomings. For example, incandescent lighting systems have the advantage of low cost because they can operate from line voltage and thus do not require special power supplies. However, incandescent bulbs typically have short life and often are not easily replaceable. Also, as purely resistive devices, they can generate substantial heat that can damage heat-sensitive components in their proximity and reduce user comfort. Moreover, incandescent bulbs are not particularly energy efficient.

Fluorescent lamps overcome some of the foregoing limitations in that they are energy efficient and typically operate at cooler temperatures. However, they have other limitations, perhaps most notably, the need for a power supply including a ballast and associated circuitry. These components add complexity, cost, and weight, and they occupy space that could be better utilized for other features. Like incandescent bulbs, the life of fluorescent bulbs is limited and they, too, can be difficult to replace.

SUMMARY OF THE INVENTION

The present invention is directed to lighting systems preferably having the characteristics of uniform light distribution, high energy efficiency, long life, and low cost. These lighting systems are particularly well-suited for use as convenience lights for appliances, such as ranges and refrigerators. The present invention also can be embodied in any number of other applications, including as a stand-alone lighting system.

In a preferred embodiment, the invention includes a number of point light sources assembled to a reflector. The light sources preferably are light emitting diodes, but other light sources can be used, as well. A power supply can be included, as necessary, to, for example, regulate voltage and current and provide thermal protection.

DETAILED DESCRIPTION OF THE ILLUSTRATED EMBODIMENT

Figure 6:
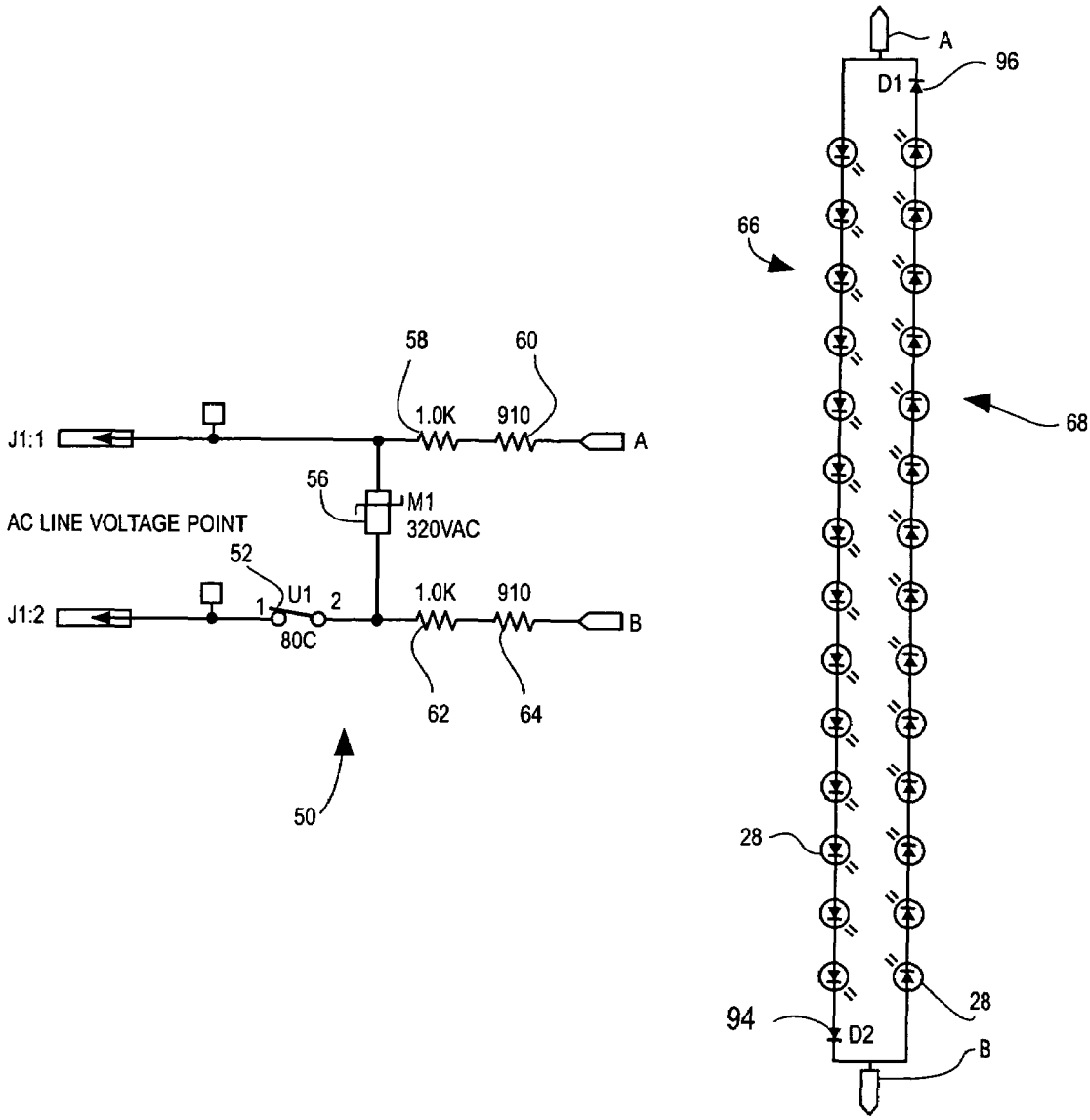
FIG. 6 is a schematic diagram corresponding to the apparatus illustrated in FIG. 1.
Figure 7:
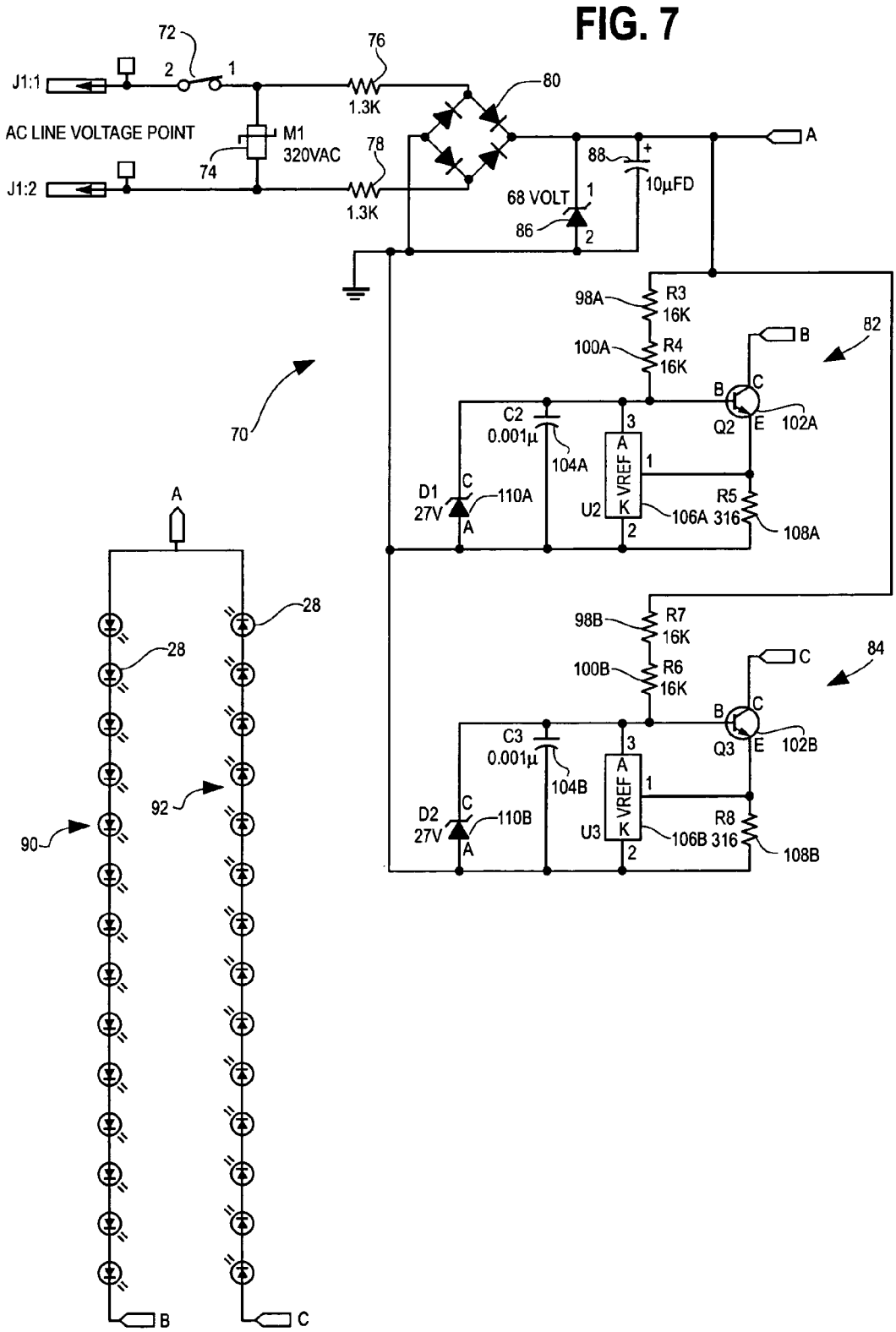
FIG. 7 is a schematic diagram corresponding to the apparatus illustrated in FIG. 1.

FIGS. 1-5 and 5A illustrate preferred embodiments of a convenience light 10 according to the present invention, including three major subcomponents or subassemblies, namely, reflector housing 12, light source board 14, and power supply board 16. FIGS. 6-7 illustrate schematically preferred power supplies for use in connection with convenience light 10.

Figure 1:
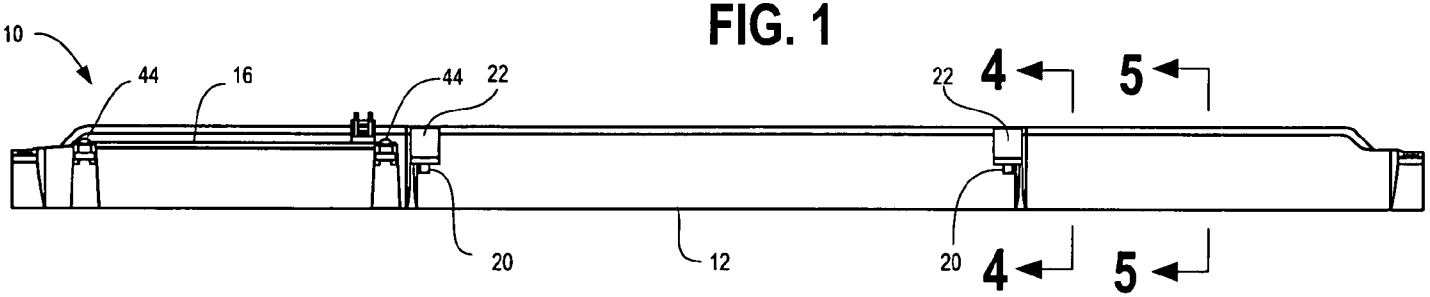
FIG. 1 is a top plan view of an apparatus according to a preferred embodiment of the invention.
Figure 2:
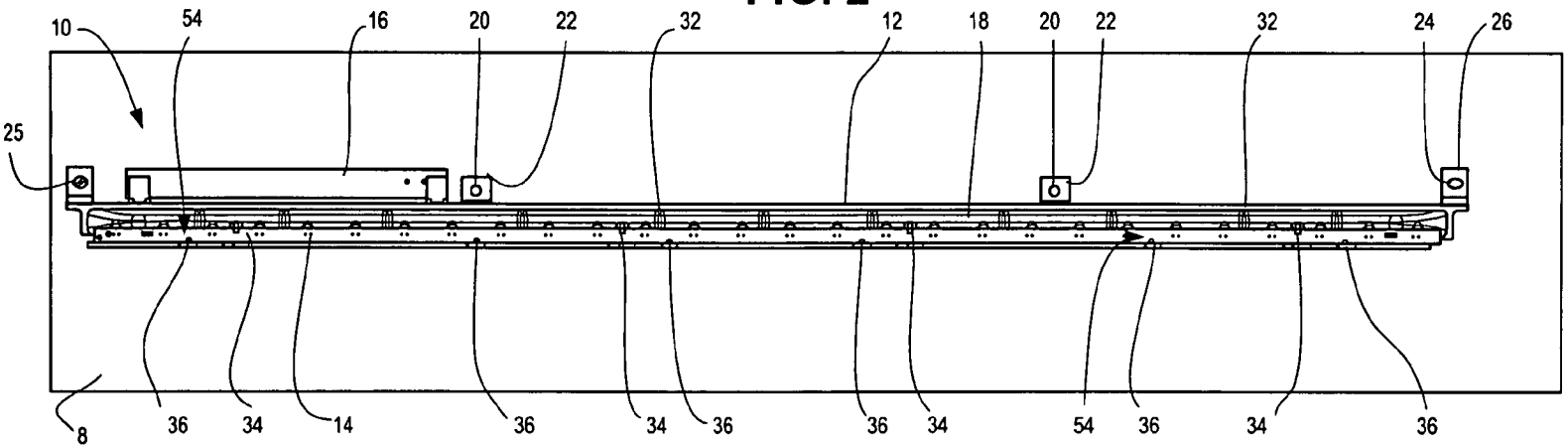
FIG. 2 is a front elevation view of the apparatus illustrated in FIG. 1 installed in a host apparatus.
Figure 3A:
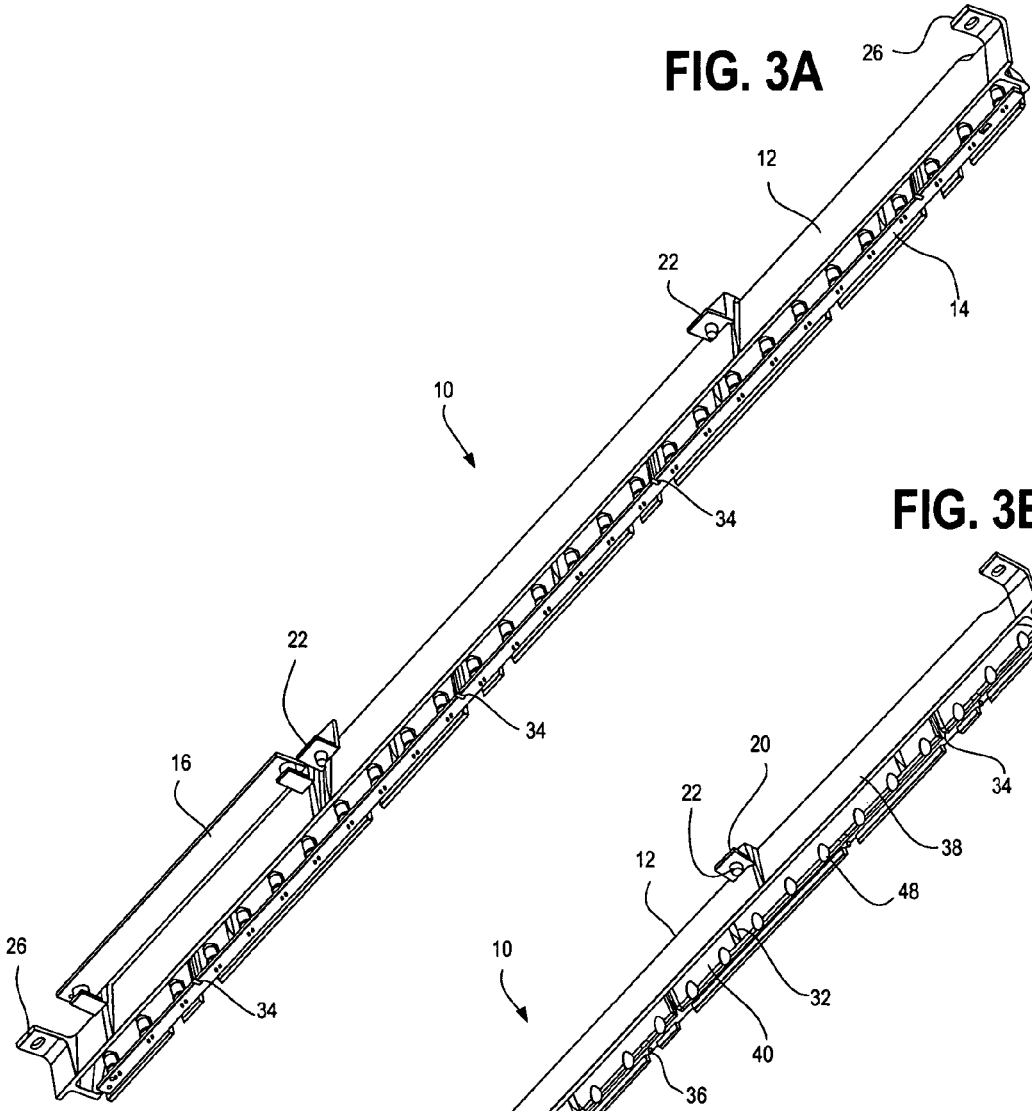
FIG. 3A is a perspective view of the apparatus illustrated in FIG. 1.
Figure 3B:
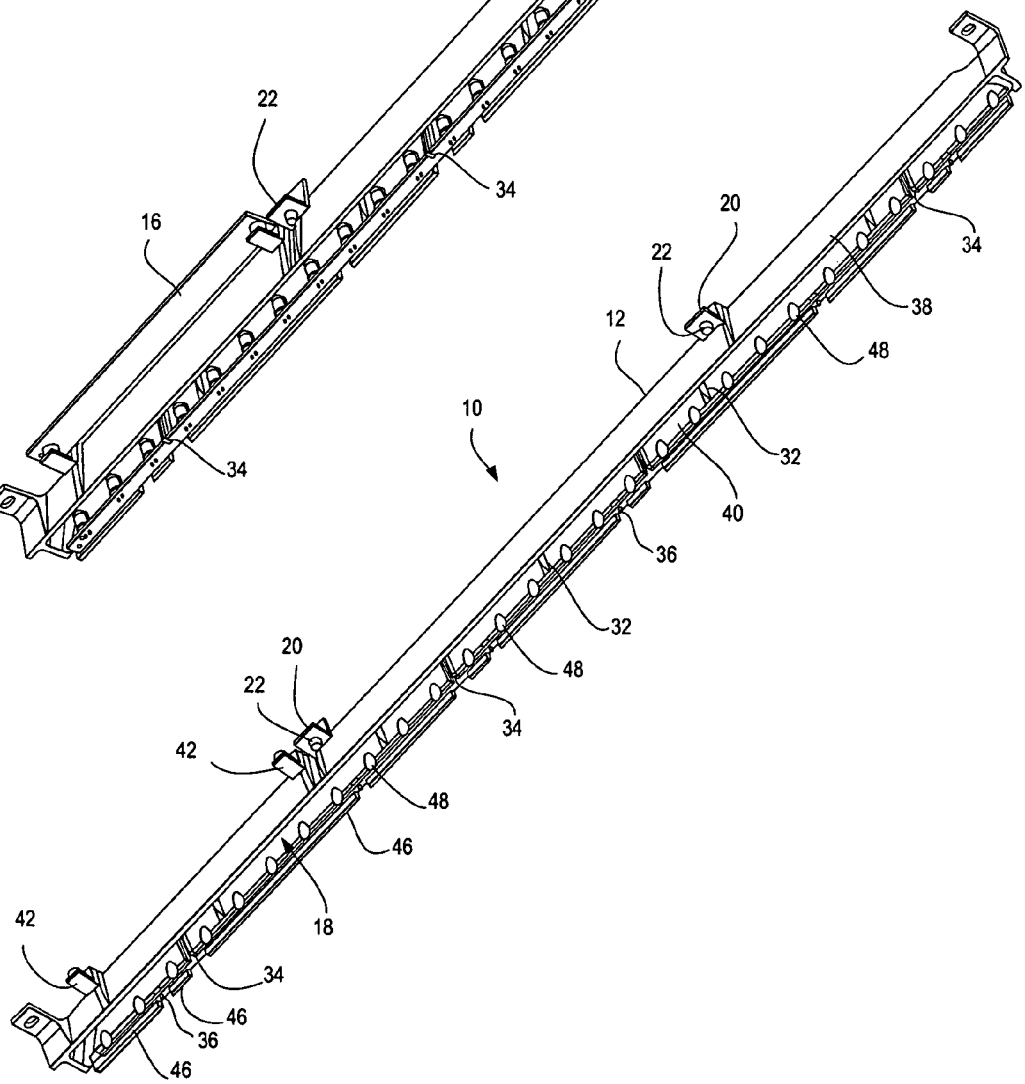
FIG. 3B is a perspective view of a portion of the apparatus illustrated in FIG. 1.
Figure 3C:
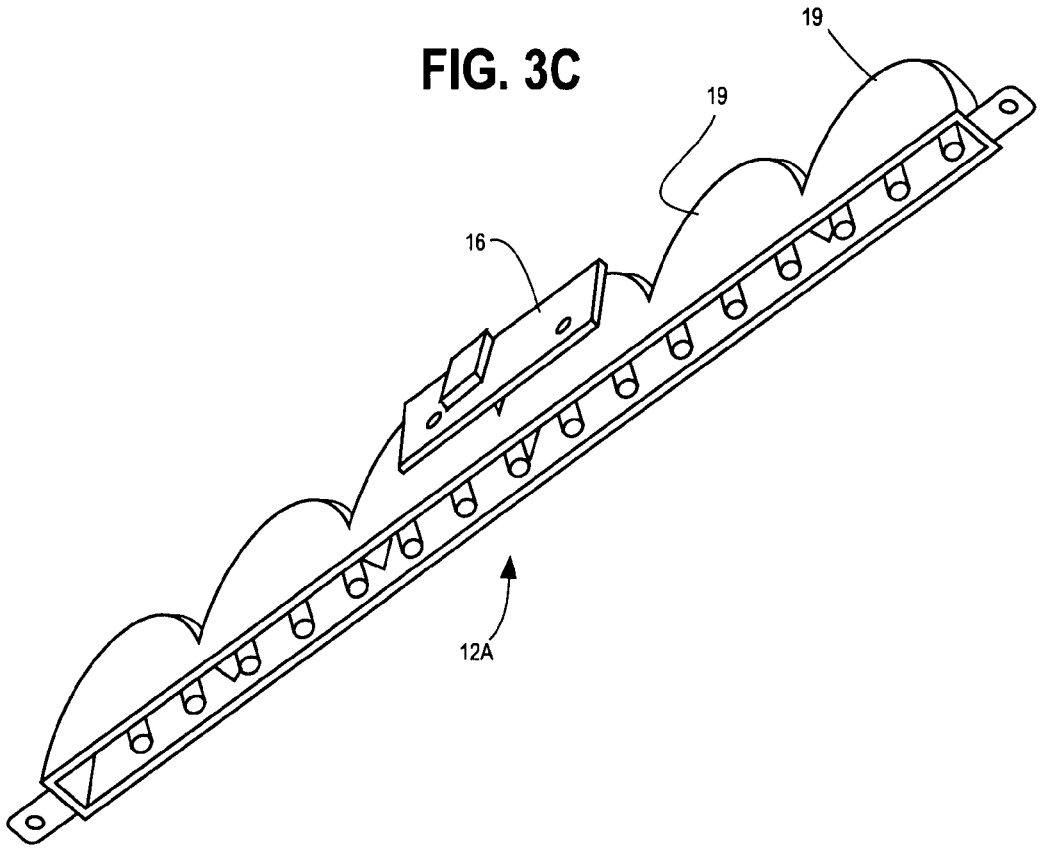
FIG. 3C is a perspective view of an alternate embodiment of a portion of the apparatus illustrated in FIG. 1.
Figure 4:
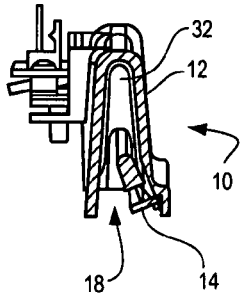
FIG. 4 is a cross-sectional view of the apparatus illustrated in FIG. 1.
Figure 5:
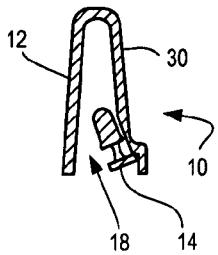
FIG. 5 is a second cross-sectional view of the apparatus illustrated in FIG. 1.

Referring particularly to FIG. 3B, reflector housing 12 preferably is embodied as an elongated structure having sidewalls 38, 40 defining a channel 18 having a generally parabolic cross section (see also FIGS. 4 and 5). This structure is readily scalable so that convenience light 10 can be fabricated in any desired length and provide substantially even light intensity along such length. (FIG. 3C illustrates an alternate reflector housing 12A embodies as a generally elongated structure having sidewalls 38A, 40A defining multiple parabolic cavities 19. The following discussion directed to reflector housing 12 generally is applicable to alternate reflector housing 12A, as well, as would be understood by one skilled in the art.) In preferred embodiments, interior surface 30 (see FIG. 5) of reflector housing 12 promotes diffusion of light introduced to channel 18 by light sources 28 (as described further below), so that light exiting channel 18 is of substantially even and uniform intensity. Various molded plastics and resins, for example, polycarbonate, yield a suitable surface. In other embodiments, interior surface 30 of reflector housing 12 (see FIG. 5) can be highly reflective so as to directly reflect light about and out of channel 18. In such embodiments, light exiting channel 18 likely will not be of even intensity and will exhibit local "hot spots." Reflector housing 12 can include one or more reinforcing ribs 32 disposed within channel 18 to strengthen housing 12 and resist collapse of sidewalls 38, 40 forming channel 18. One or both sidewalls 38, 40 of reflector housing 12 can include scallops 48 to provide sufficient clearance for light sources 28 when light source board 14 is assembled to reflector housing 12.

Reflector housing 12 preferably includes power supply board mounting tabs 42, which preferably are adapted to receive mounting screws 44 (see FIG. 1) inserted through apertures (not shown) on power supply board 16, thus securing power supply board 16 to reflector housing 12. Other embodiments can include additional or alternative structure for installing and securing power supply board 16 to reflector housing 12. Alternatively, power supply board 16 can be located remote from reflector housing 12, in which case reflector housing 12 need not include any provisions for mounting power supply board 16 thereto.

Reflector housing 12 can, but need not, include alignment tabs 20 having alignment pins 22 to facilitate installation of convenience light 10 into a host apparatus, for example, a refrigerator or other appliance, having corresponding receptacles (not shown). Reflector housing 12 preferably includes mounting tabs 26 having apertures 24. Mounting screws 25 can be inserted through apertures 24 and into corresponding structure (not shown) of a host apparatus 8 to secure convenience light 10 to such host apparatus. Alternatively, apertures 24 can receive mounting pins, mounting studs, or other corresponding structure (not shown) projecting from a host apparatus, to secure light 10 to such host apparatus, as would be known to one skilled in the art, using additional fastener components (not shown), as necessary.

Reflector housing 12 preferably further includes structure for locating and securing light source board 14 thereto. For example, reflector housing 12 can include one or more locating pins 36 which engage with corresponding cutouts or apertures 54 in light source board 14 (see FIG. 2) to prevent or inhibit lateral movement of light source board 14 once it has been assembled to reflector housing 12, and one or more retaining flanges 46 and retaining clips 34 to secure light source board 14 to reflector housing 12. Preferably, light source board 14 can be readily removed from reflector housing 12 to facilitate replacement of light source board 14, if necessary.

Reflector housing 12 can be made of metal, plastic, resin or any other suitable material. Preferably, reflector housing 12 is made of a heat resistant material, that is, a material that is resistant to softening, distortion, embrittlement, and/or discoloration when subjected to heat, particularly when subjected to heat for an extended period of time. In a preferred embodiment, reflector housing 12 is molded from a heat resistant plastic or resin that yields a highly reflective surface, as discussed above. Preferably, the various mounting tabs, pins, and reinforcing ribs described above are molded monolithically with reflector housing 12, although in alternative embodiments they could be separate structures that later are joined, mechanically or otherwise, to reflector housing 12.

Light source board 14 is illustrated as a narrow, elongated structure, preferably a printed wiring board, bearing a number of light sources 28, preferably point light sources, which are attached to light source board 14 by any suitable means. The size and shape of light source board 14 generally correspond to the size and shape of the area of reflector housing 12 to which light source board 14 is assembled. Light sources 28 preferably are light emitting diodes, but also can be organic light emitting diodes, light emitting polymers, or other suitable light sources. Light sources 28 are electrically connected to power supply board 16 andlor to each other in a predetermined manner, as discussed further below. In a preferred embodiment wherein light source board 14 is a printed wiring board, electrical traces (not shown) on the wiring board can provide such electrical connections. In other embodiments, wires or other suitable means (not shown) can be used to electrically connect light sources 28 to power supply board 16 and/or to each other.

Figure 5A:
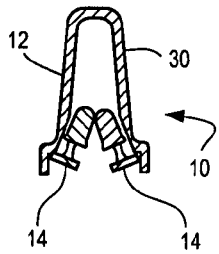
FIG. 5A is a cross-sectional view of an alternate embodiment of the apparatus illustrated in FIG. 1.

In a preferred embodiment, light sources 28 are configured on light source board 14 in a generally linear, columnar arrangement as shown in, for example, FIG. 3A. In alternate embodiments, light sources 28 can be mounted on light source board 14 in two or more columns in a staggered, parallel, or other suitable arrangement. Light source board 14 is shown in, for example, FIG. 3A as a single board assembled to reflector housing 12 adjacent sidewall 40. In alternate embodiments, two or more light source boards 14 can be mounted adjacent one or both sidewalls 38, 40 in linear, parallel, or staggered arrangements. See, for example. FIG. 5A.

Power supply board 16 bears a power supply, for example, power supply 50 illustrated schematically in FIG. 6. Power supply 50 is electrically coupled at an input end to a suitable source of power, for example, the 120 VAC power source used to operate an apparatus, such as an appliance, that convenience light 10 might be installed in. Power supply 50 is coupled at an output end to light sources 28. Power supply board 16 preferably is attached to reflector housing 12, but also can be embodied as a remote subassembly electrically coupled to light sources 28, as described above.

Power supply 50 preferably includes thermal switch 52 which preferably is located at the input end of power supply 50. Thermal switch 52 is configured to open when a predetermined temperature is exceeded and to close when the switch temperature is below the predetermined temperature (thermal switch 52 may have a dead band to prevent chatter at temperatures near the set point, as would be known to one skilled in the art). Thermal switch 52 can be embodied as a conventional bimetallic switch or any other suitable structure for opening and closing an electrical circuit based on temperature. Thermal switch 52 protects solid state components, for example, light emitting diodes embodying light sources 28 in a preferred embodiment, from over-temperature conditions that might occur when light sources 28 are energized for an extended period of time, particularly under high ambient temperature conditions. Such conditions might occur, for example, where convenience light 10 is embodied in an oven, particularly during the oven's self-cleaning cycle, which uses extremely high temperatures to burn deposits off of the oven's interior surfaces.

Power supply 50 also preferably includes a surge suppressor, for example, metal oxide varistor 56, to protect light sources 28 from voltage spikes. Power supply 50 further preferably includes one more current limiting devices, such as resistors 58, 60, 62, 64, for limiting current to light sources 28.

In the FIG. 6 embodiment, power supply 50 is driven by line voltage. In other embodiments, power supply 50 can be driven by other power sources. In this preferred embodiment, light sources 28 are light emitting diodes arranged in two electrically parallel strings 66, 68 of series-connected devices such that light sources 28 in first string 66 conduct current in a first direction, while light sources 28 in second string 68 conduct current in the opposite direction. Diodes 94, 96 protect light emitting diodes embodying light sources 28 from excess reverse voltage. In alternate embodiments using non-self-rectifying light sources 28, diodes 94, 96 also serve to rectify current through strings 66, 68. As such, light sources 28 in each electrical string 66, 68 are energized only during each half cycle of alternating current. This arrangement essentially halves the amount of energy used to energize light sources 28 and significantly reduces the amount of heat generated by light sources 28 during normal operation.

This arrangement also can significantly extend the useful life of light sources 28. Further, an electrical failure in one string generally will not affect the other string. For example, if a light source 28 in one electrical string 66, 68 burns out, causing an open circuit in that string, the other string will not be affected.

In the foregoing arrangement, light sources 28 in each electrical string 66, 68 turn on and off thirty times per second (assuming a 60 Hz line frequency). The human eye can detect the resulting flicker. In order to mitigate the effect of this flicker, light sources 28 associated with first string 66 preferably are interlaced physically with light sources associated with second string 68, so that, generally, during normal operation, one of any pair of adjacent light sources is energized at any given time and the other of the pair is de-energized at that time.

Each electrical string 66, 68 of light sources 28 is shown in FIG. 6 as including fourteen light sources 28. In alternate embodiments, each such string could include more than fourteen light sources 28 or as few as one light source 28. In such embodiments, lights sources 28 preferable are configured to minimize detectability of flicker, as described above. Also, alternate embodiments can use more or fewer than two electrical strings of light sources 28. In such embodiments, it is preferred to use even numbers of electrical strings of light sources 28.

FIG. 7 schematically illustrates an alternative power supply 70. Like power supply 50, power supply 70 is electrically coupled at an input end to a source of power, for example, a 120 VAC source, and at an output end to light sources 28. Power supply 70 preferably includes thermal switch 72, metal oxide varistor 74, and current limiting resistors 76, 78, which perform functions comparable to like components in power supply 60.

Unlike power supply 50, power supply 70 further includes a full wave rectifier 80, which provides a direct current output to transient voltage suppressor 86, filter capacitor 88, the input of first and second parallel strings 90, 92 of series-connected light sources 28, and first and second constant current sources 82, 84. Transient voltage suppressor 86 clamps the output voltage of rectifier 80 at a predetermined maximum voltage, as would be known to one skilled in the art. Filter capacitor 88 smoothes out voltage variations at the output of full wave rectifier 80 and supplies full load current to light sources 28. First and second constant current source circuits 82, 84 regulate current through first and second strings 90, 92 of series-connected light sources 28. Consequently, light sources 28 generally are immune from variations in input voltage to power supply 70, and they operate at a constant brightness.

First and second constant current sources 82, 84 can be embodied in any suitable form, as would be known by one skilled in the art. In the FIG. 7 embodiment, each constant current source 82, 84 includes serially coupled resistors 98A-B, 100A-B coupled to the output of rectifier 80 and to the base of transistor 102A-B, to capacitor 104A-B, to zener diode 110A-B, and to the cathode of adjustable voltage regulator 106A-B. The emitter of transistor 102A-B is coupled to the input terminal of adjustable voltage regulator 106A-B and resistor 108A-B. A constant current through light sources 28 is established by controlling the voltage drop across resistor 108A-B. Resistor 108A-B, the anode of adjustable voltage regulator 106A-B, zener diode 110A-B, and capacitor 104A-B are coupled to ground.

Each electrical string 90, 92 of light sources 28 is shown in FIG. 7 as including fourteen light sources 28. In alternate embodiments, each such string could include more than fourteen light sources 28 or as few as one light source 28. Also, alternate embodiments can use more or fewer than two electrical strings of light sources 28. In such embodiments, it is preferred to provide a constant current source corresponding to each such electrical string of light sources 28.

Power supply 50 generally can be fabricated at a lower cost than power supply 70 and is preferable in low cost applications. Power supply 70 is more complex and costlier to build than power supply 50, but is preferable in applications where additional cost is acceptable because it yields lower light source 28 operating temperatures and the brightness of light sources 28 does not vary with input voltage.

Values of resistance, capacitance, and the like stated in the drawings are representative and not to be construed as limiting the scope of the present invention. One skilled in the art would know to make many modifications to the embodiments of the invention disclosed herein without deviating from the scope of the following claims.

The invention claimed is:

1. A lighting apparatus, comprising:

a reflector housing comprising an elongated channel having a first side wall, a second side wall, a first end, a second end, a rear portion, and an open front portion, said reflector housing defining at least one cavity;

a plurality of light emitting point sources connected to at least one of said first side wall and said second side wall proximate said open front portion of said reflector housing wherein at least one of said light emitting point sources is located at a predetermined location along the length of said reflector housing between said first end and said second end; and a power supply electrically coupled to said light emitting point sources;

wherein said plurality of light emitting point sources is oriented such that the light emanating directly from said plurality of light emitting point sources is substantially directed toward one or more of said first side wall, said second side wall, and said rear portion of said cavity and not substantially toward said open front portion of said cavity.

2. The apparatus of claim 1 wherein said reflector housing defines a plurality of cavities.

3. The apparatus of claim 2 wherein at least one of said light emitting point sources is operably associated with each of said cavities.

4. The apparatus of claim 1 wherein said reflector housing defines a channel having a substantially parabolic cross section.

5. The apparatus of claim 1 wherein each of said plurality of light emitting point sources comprises a solid state light source.

6. The apparatus of claim 5 wherein each of said solid state light sources comprises a light emitting diode.

7. The apparatus of claim 1 wherein said plurality of light emitting point sources is arranged as a column of light sources.

8. The apparatus of claim 7 wherein said light emitting point sources are electrically coupled in series.

9. The apparatus of claim 1 wherein said plurality of light emitting point sources is arranged as an array of rows and columns of light sources.

10. The apparatus of claim 1 wherein a rectifier is electrically coupled in series with said plurality of light emitting point sources.

11. The apparatus of claim 10 wherein said rectifier comprises a diode.

12. The apparatus of claim 11 wherein said power supply further comprises a thermal protection device.

13. The apparatus of claim 12 wherein said light emitting point sources are arranged such that each of said light emitting point sources is energized during alternating half-cycles of alternating current power supplied to said apparatus.

14. The apparatus of claim 13 wherein said light emitting point sources are arranged such that one of a pair of adjacent light emitting point sources is energized during alternating half-cycles of alternating current power supplied to said apparatus and the other of said pair of adjacent light emitting point sources is not energized during said half-cycles of alternating current power supplied to said apparatus.

15. The apparatus of claim 13 wherein said thermal protection device is a thermal switch.

16. The apparatus of claim 1 wherein said power supply comprises at least one resistor electrically coupled with a transient voltage suppressor.

17. The apparatus of claim 1 wherein said light emitting point sources are arranged such that each of said light emitting point sources is energized during alternating half-cycles of alternating current power supplied to said apparatus.

18. The apparatus of claim 17 wherein said light emitting point sources are arranged such that one of a pair of adjacent light emitting point sources is energized during alternating half-cycles of alternating current power supplied to said apparatus and the other of said pair of adjacent light emitting point sources is not energized during said half-cycles of alternating current power supplied to said apparatus.

19. The apparatus of claim 1 wherein said apparatus comprises a portion of an appliance.

20. The apparatus of claim 1 wherein at least a portion of said plurality of light emitting point sources is attached to a first light source board, said first light source board connected to one of said first side wall and said second side wall.

21. The apparatus of claim 20 wherein at least a portion of said plurality of light emitting point sources is attached to a second light source board, said second light source board connected to the other of said first side wall and said second side wall.

22. The apparatus of claim 1 wherein said plurality of light emitting point sources is connected to said reflector housing such that said each of said plurality of light emitting point sources is offset from the center line of said channel.

* * * * *